United States Patent [19]

Hahm

[11] Patent Number: 4,823,565

[45] Date of Patent: Apr. 25, 1989

[54] WINDING SUPPORT

[76] Inventor: Manfred Hahm, Ahornweg 17, 5100 Aachen, Fed. Rep. of Germany

[21] Appl. No.: 177,895

[22] Filed: Mar. 29, 1988

Related U.S. Application Data

[63] Continuation of Ser. No. 722,269, Apr. 11, 1985, abandoned.

[30] Foreign Application Priority Data

Apr. 11, 1984 [DE] Fed. Rep. of Germany ... 8411284[U]

[51] Int. Cl.[4] ..... D06B 23/04

[52] U.S. Cl. ..... 68/198; 242/118.1; 242/118.2

[58] Field of Search ..... 68/184, 198; 242/118, 242/118.1, 118.2, 118.7

[56] References Cited

U.S. PATENT DOCUMENTS

| | | | |
|---|---|---|---|
| 2,696,951 | 12/1954 | Wood | 242/118.7 |
| 2,775,418 | 12/1956 | Cadman | 242/118.7 |
| 2,777,648 | 1/1957 | Wood | 242/118.7 |
| 2,858,999 | 11/1958 | Guentner, Jr. | 242/118.7 X |
| 2,922,596 | 1/1960 | Morin | 242/118.7 |
| 2,978,202 | 4/1961 | Morin | 242/118.7 |
| 3,563,491 | 2/1971 | Hahm | 68/198 X |
| 3,718,287 | 2/1973 | Sottosanti | 242/118.11 |
| 3,753,534 | 8/1973 | Ono et al. | 242/118.11 |
| 4,454,734 | 6/1984 | Marquis et al. | 68/198 |

FOREIGN PATENT DOCUMENTS

| | | | |
|---|---|---|---|
| 1416340 | 9/1965 | France | 242/118.1 |
| 2259521 | 8/1975 | France | 242/118.7 |

*Primary Examiner*—Harvey C. Hornsby
*Assistant Examiner*—Frankie L. Stinson
*Attorney, Agent, or Firm*—Herbert L. Lerner; Laurence A. Greenberg

[57] ABSTRACT

A winding support for the treatment of threads or yarns includes a shell ring having openings formed therein, the shell ring having two end rings and intermediate rings disposed between the end rings, the intermediate rings being formed of a multiplicity of ring elements, and spacer elements interconnecting the ring elements in the shell ring, all of the spacer elements having surfaces extended in the same direction.

25 Claims, 10 Drawing Sheets

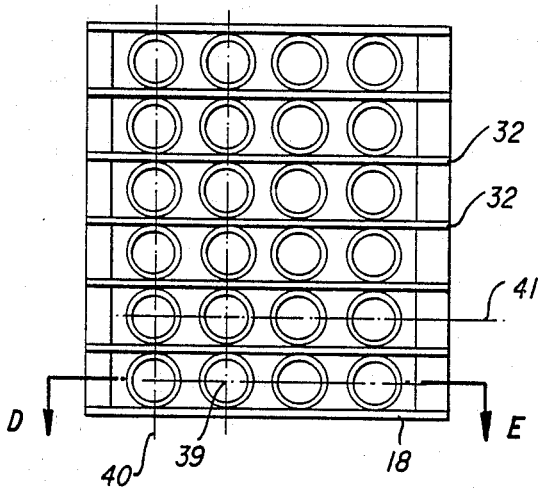
Fig. 7
Fig. 7a
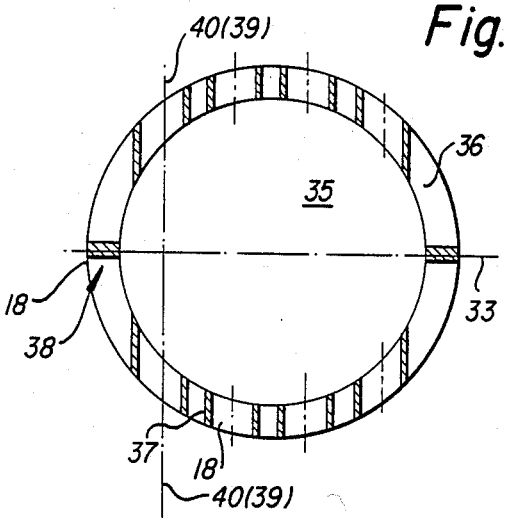
Fig. 7c
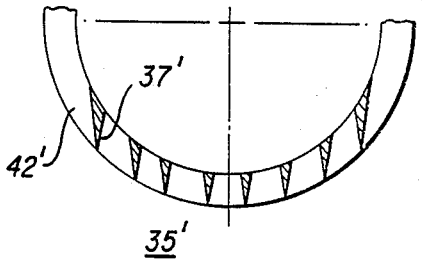
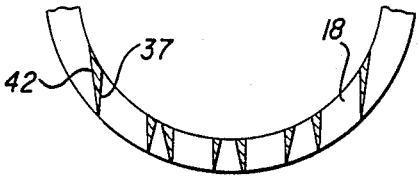
Fig. 7b

WINDING SUPPORT

This application is a continuation of application Ser. No. 772,269, filed Apr. 11, 1985, now abandoned.

The invention relates to a winding support for the treatment of threads or yarns, having an open or perforated shell ring with two end rings and a multiplicity of elements forming intermediate rings, and spacer elements disposed in the shell ring and interconnecting the elements forming the intermediate rings.

Winding supports of the above-described type are in common use and are well proven. Depending on their particular application, such winding supports must meet a great variety of deformation requirements. Winding supports of the conventional type may be cylindrical, conical, or bi or double conical. Depending on their particular application they must be rigid or axially flexible. Even radial flexibility is sometimes required. It may also be useful for such winding supports to be axially flexible under compressive radial motion. They are sometimes both elastically and plastically deformable.

Depending on the characteristic required, different winding support structures, which differ especially regarding the construction of the intermediate rings and webs, are adapted to the desired deformability. For example, German Patent DE-PS No. 1,760,818 has disclosed such a winding support which is readily deformable both radially and axially. An example of winding structure which is flexible in axial direction only, is evident from German Published, Prosecuted Application DE-AS No. 23 63 250. An example of a winding support in which a radial deformation occurs automatically when deformed axially, is evident from German Published, Prosecuted Application DE-AS No. 17 60 652.

Thus, winding supports with a varied structure adapted to the desired deformation, are known in the state of the art.

Such winding supports are preferably molded of plastic by means of a suitable mold. However, molds or tools for producing winding supports with a conventional structure have the disadvantage of requiring more than two jaws or cheeks so that the mold components can be moved apart after the molding operation and the molded part taken out. This makes the molds very expensive and also very large if several winding supports are to be molded in one operation.

A winding support moldable in a four jaw mold has become known from French Pat. No. 1,416,340. However, even such a mold is still large and complicated in its construction and hence expensive, and the structure of such a winding support is difficult to alter in order to obtain different deformation characteristics.

It is accordingly an object of the invention to provide a winding support which overcomes the hereinaforementioned disadvantages of the heretofore-known devices of this general type, and which can be molded in a two-jaw mold and yet can be varied in its structure while still using such a mold so that all conventional, desired deformation characteristics are attainable.

With the foregoing and other objects in view there is provided, in accordance with the invention, a winding support for the treatment of threads or yarns, comprising a shell ring having openings or perforations formed therein, the shell ring having two end rings and intermediate rings disposed between the end rings, the intermediate rings being formed of a multiplicity of ring elements, and spacer elements interconnecting the ring elements in the shell ring, all of the spacer elements having surfaces or generating lines extended in the same direction. These unidirected surfaces or generating lines represent the travel direction of the two mold jaws so that the winding support can be readily produced in such a mold due to the unidirected surfaces or generating lines of the spacer elements. At the same time, the spacer elements may be of numerous different structures, in order to produce certain deformation and elasticity properties, as long as they meet the condition of all having unidirected surfaces or generating lines, since it is only this condition that permits the construction of such a mold for molding the winding support.

Since a two-jaw mold has only one plane of separation, an interesting embodiment of the invention results due to the presence of this plane of separation.

In accordance with an added feature of the invention, the shell ring has a first sectional plane disposed along a diameter thereof, and including other spacer elements being disposed one exactly below the other and opposite each other, each of the other spacer elements being disposed between a respective two of the ring elements, the other spacer elements having surfaces or generating lines disposed parallel to the first sectional plane, the surfaces of the first-mentioned spacer elements being disposed in second sectional planes offset by 90° from the first sectional plane.

In accordance with an additional feature of the invention two of the other spacer elements are each disposed between a respective one of the ring elements and a respective one of the associated end rings. The surfaces of the other spacer elements are therefore aligned as described above, whereas the first-mentioned spacer elements lie exactly one below the other on the one hand, and in the plane of separation of the two jaws on the other hand, so that their altered configuration does not affect the separability of the mold, while a different construction providing a different deformation behavior of the winding support can be obtained.

In accordance with a further feature of the invention, the first-mentioned spacer elements, i.e. all except those associated with the first sectional plane, are offset or staggered in circumferential direction relative to the next adjacent one of the first-mentioned spacer elements above or below them. What this achieves is that, despite its moldability in a two-jaw mold, the winding support is deformable both axially and radially and that, when compressively deformed axially, a radial deformation is caused. The applications and the advantages of certain deformabilities are known per se in the state of the art. For this reason, they are not repeated here. The object of the invention is rather to construct winding supports of different deformabilities so as to be producible in a two-jaw mold. This is provided with the respective features and embodiments of the invention.

In accordance with an additional feature of the invention, the spacer elements are rigid in axial direction. For certain applications, this also results in a desired deformation behavior of the winding support. If all of the spacer elements are disposed strictly one under the other, the result will be a rigid winding support, whereas if these spacer elements are offset in the various planes, the result is a winding support which is flexible both axially and radially.

In accordance with still a further feature of the invention, the first-mentioned spacer elements are rigid in axial direction, and the other spacer elements are alternately rigid and soft in axial direction. This construction is particularly advantageous when the rigid spacer elements are offset relative to each other in the planes. In conjunction with the alternately rigid and soft spacer elements of the first sectional plane, the winding support then becomes especially soft in both axial and radial direction.

In accordance with yet an added feature of the invention, the other spacer elements include inner elements being soft in axial direction and outer elements disposed furthest outside being rigid. A uniform deformation of the winding support in both axial and radial direction is achieved thereby.

In accordance with yet another feature of the invention, the first-mentioned spacer elements are at least partial boundary surfaces of hollow bodies being open at least at outer ends thereof. For instance, this makes it possible to achieve a purely axial deformation, the deforming force of which is determined by the shape and wall thickness of the hollow parts. Accordingly, the magnitude and force requirement for the axial deformation are determinable by the physical size of these limiting surfaces, and yet the moldability of the winding support in a two-jaw mold remains unaffected.

In accordance with still an added feature of the invention, the shell ring has an interior region and an exterior region, the hollow bodies each have a pair of inner and a pair of outer surfaces, the surfaces of one of the pairs of surfaces diverging toward one of the regions of the shell ring, each of the hollow bodies having planes of symmetry with section lines extended perpendicular to the axial direction of the winding support and parallel to the section lines of the others of the hollow bodies. For instance, this makes it possible to make the entire winding support more rigid in its core area and more flexible in its outer area. Here too, the winding support is producible in a two-jaw mold.

In accordance with again a further feature of the invention, at least some of the hollow bodies have surfaces disposed along the first sectional plane. This provides for a combination of the hollow parts acting as spacer elements and the planar spacer elements, thereby permitting additionally different deformabilities of the winding support in different axial planes of symmetry. Of course, this again does not adversely affect the producibility of the winding support in a two-jaw mold, and this feature applies to all other embodiments of the invention as well.

In accordance with again an additional feature of the invention, there are provided ring segments mutually oppositely disposed between the intermediate rings and supported by the first mentioned and other spacer elements, the first sectional plane being a plane of symmetry of the ring segments. Depending on the winding support construction selected, it is possible for interspaces of undesirable size to appear between the intermediate rings in the areas mentioned. The above-mentioned feature reduces these interspaces to the desired size.

In accordance with still an added feature of the invention, the intermediate rings have increasing diameters as seen in a given direction. While leaving all of the features described so far intact, this makes it possible, in addition, to construct a winding support whose essential shape is not only cylindrical, but which can also be conical, bi or double conical, or either partially or completely sinusuidal. When treating certain fibers, these shapes may also offer very specific advantages.

In accordance with still another feature of the invention, there are provided hollow bodies formed in at least a plurality if the intermediate rings interrupting the intermediate rings in circumferential direction, the hollow bodies being aligned with at least the first-mentioned spacer elements being spaced from the first sectional plane, and being open at least at ends thereof. Regarding desired deformation directions, this makes it possible, for instance, to achieve a two stage behavior of the winding support. First, the deforming travel of the elements originally provided for the deformation is exhausted and if required, depending on the external circumstances, an additional deforming travel may then be utilized, such as one built-in for safety reasons, as described above. This additional deformation possibility can be exploited in both axial and radial direction, either separately or in combination.

In accordance with still a further feature of the invention, the hollow bodies formed in adjacent intermediate rings are interconnected forming additional spacer elements. In this manner, the above-described features are combined with each other in a structurally simplified manner.

In accordance with yet an additional feature of the invention, at least the spacer elements supporting the ring segments have bends formed therein for inwardly shifting the ring segments upon axial movement of adjacent ones of the intermediate rings. Through this construction, space is very quickly required for wound fibers which become narrower.

In accordance with yet another feature of the invention, the winding support has a body with an inner surface with an at least partially oval cross section along the direction of the first sectional plane, except at the end rings. It is possible for certain spacer elements to project inwardly beyond the inner surface, when deformed, so that in such a case the winding sleeve would jam on the dyeing spear. In conjunction with the specially aligned shape of the spacer elements, the oval shape described above creates the required space without losing the guidance of the winding support on the dyeing spear.

In accordance with again a further feature of the invention, at least some of the spacer elements have predetermined . buckling points. The predetermined buckling points may run in the direction of movement of the two jaws of the mold for the production of the winding support, so that the producibility of the winding support according to the invention by means of a mold which was already described, is also not adversely affected by this measure.

In accordance with again an added feature of the invention, the spacer elements have a shape chosen from the group consisting of: straight, oblique, buckled, bent, C-shaped, O-shaped, and S-shaped. All of these are spacer element shapes with which a desired deformation behavior of the winding support can be obtained and which nevertheless permit the use of a two-jaw mold for the production of the winding support, in the structure according to the invention.

In accordance with still an additional feature of the invention, the ring elements forming the intermediate rings have at least one of the shapes chosen from the group consisting of: straight, buckled, wave-shaped, and a shape provided with predetermined buckling points. This measure also permits the deformation behavior of the winding support according to the invention to be influenced in a desired manner without the loss of any of its advantages.

In accordance with still a further feature of the invention, the winding support has a body with two ends at which the end rings are disposed, one of the end rings having inner centering means for centering a dyeing spear and outer centering means for an end ring of another body, and the other of the end rings having centering means for the outer centering means of a further body. While retaining all other advantages, this measure provides alignment of the individual winding supports relative to each other and enables them to be plugged together to form securely guided and aligned winding support columns, thereby facilitating uniform dyeing of the wound material.

In accordance with again an added feature of the invention, the spacer elements are alternately rigid and soft in axial direction of the winding support. This is a particularly simple manner of generating different deforming behavior zonewise without thereby adversely affecting removal from the mold during the production in a two-jaw mold.

In accordance with still another feature of the invention, the spacer elements are disposed in adjacent ranges, and all of the spacer elements in a given range are disposed in the same axial sectional planes as the spacer elements of the adjacent range. Such a structure relieves the intermediate rings and yet makes it possible to selectively construct an axially rigid as well as an axially soft winding support, both overall or zonewise.

In accordance with still a further feature of the invention, at least one of the end rings has a spare thread groove formed thereon. Such a groove is already known in the state of the art and it can advantageously be molded in at the same time in a two-jaw mold without difficulty.

In accordance with a concomitant feature of the invention, the spacer elements have a connection region, and have decreasing widths at least in the connection region, in direction from the outside of the winding support.

Other features which are considered as characteristic for the invention are set forth in the appended claims.

Although the invention is illustrated and described herein as embodied in a winding support, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, side-elevational view of part of a winding support;

FIG. 1*a* is an elevational view taken in the direction of the arrow I in FIG. 1;

FIG. 7 is a side-elevational view of another embodiment of a winding support;

FIG. 7*a* is a cross-sectional view taken along the line D-E in FIG. 7, in the direction of the arrows;

FIG. 7*b* is a fragmentary view of another embodiment of the device shown in FIG. 7*a;*

Figure 8:
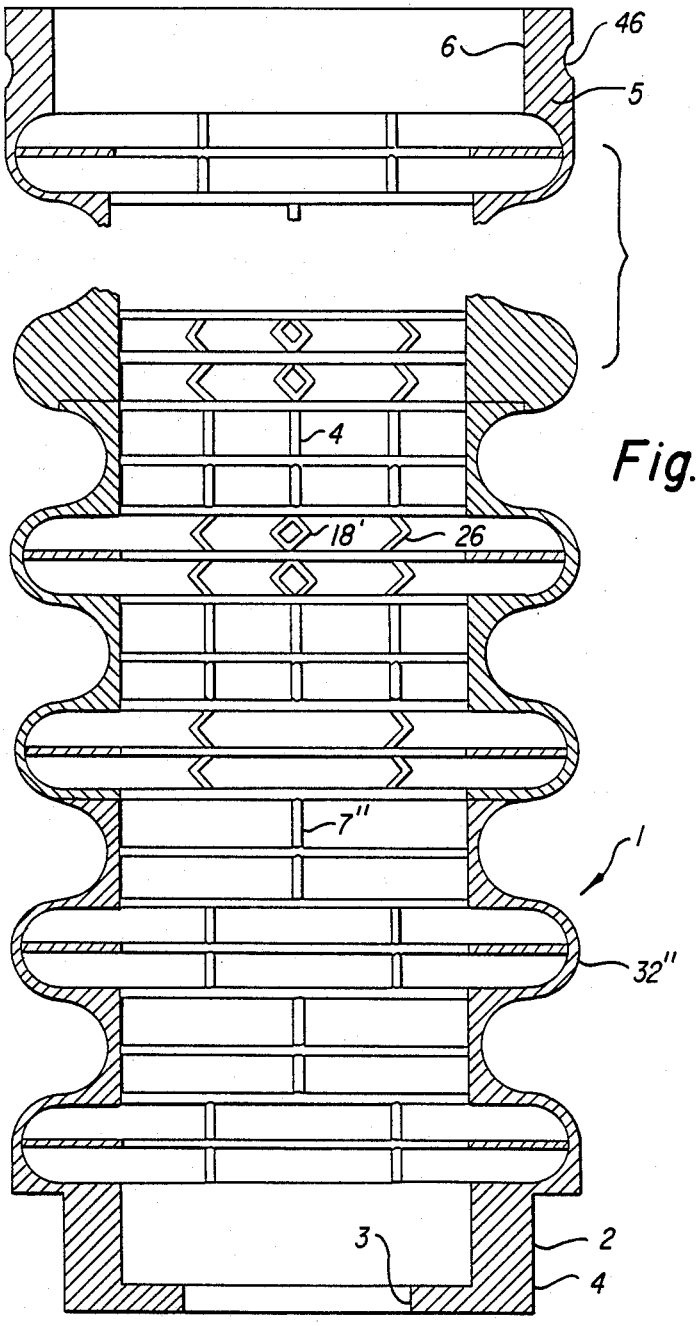
Figure 9:
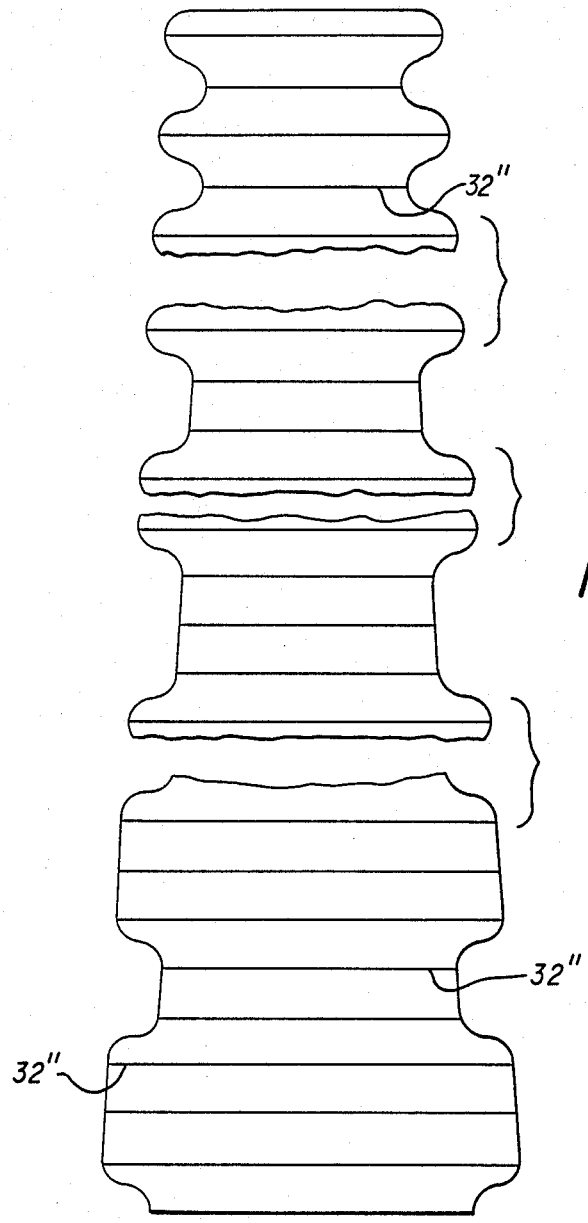
Figure 10:
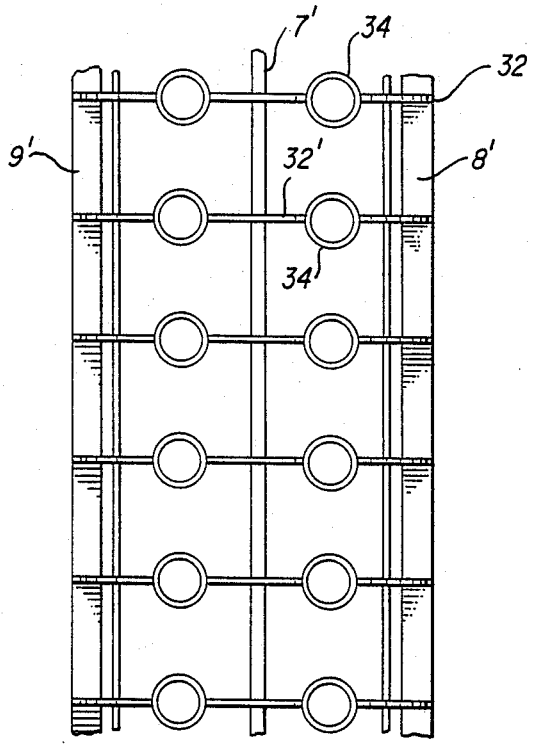
Figure 11:
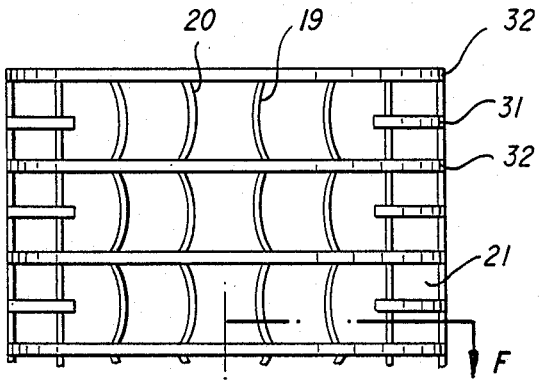
Figure 12:
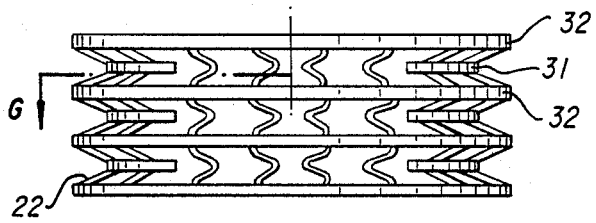
Figure 13:
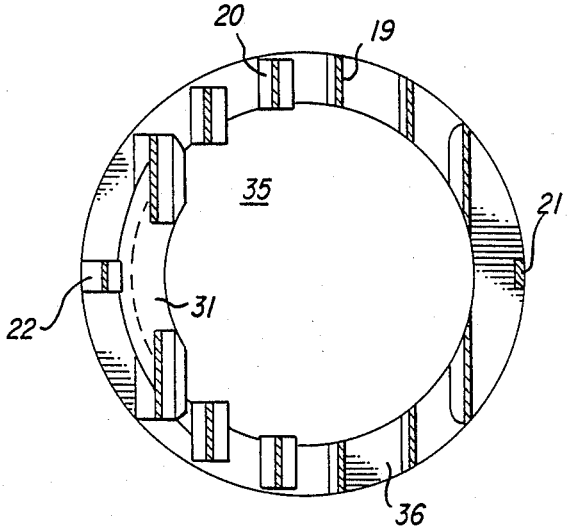
Figure 12A:
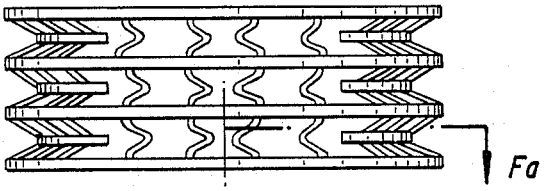
Figure 11A:
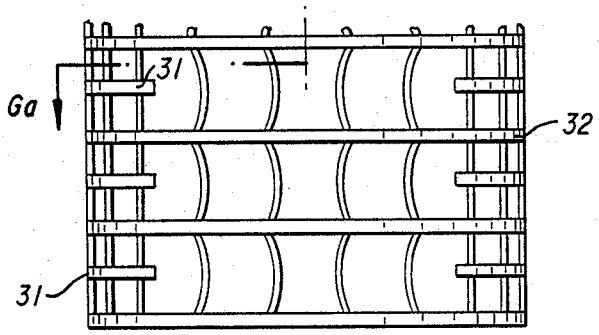
Figure 13A:
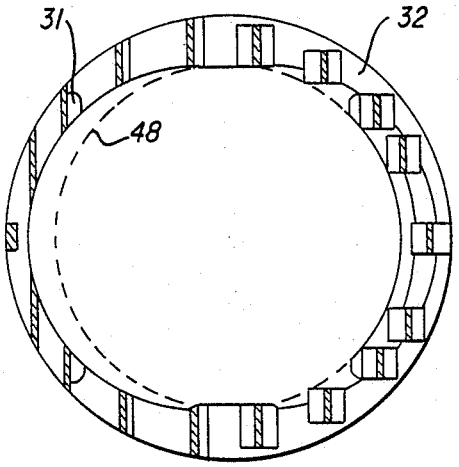
Figure 15:
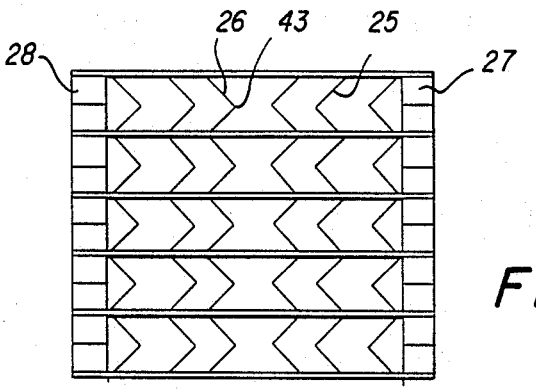
Figure 14:
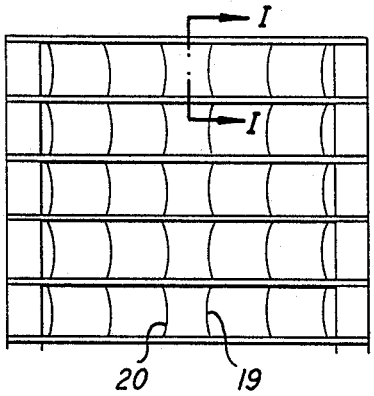
Figure 16:
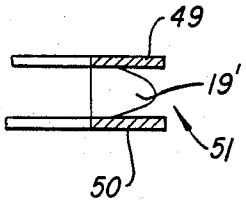

FIG. 7*c* is a view similar to FIG. 7*b* of a further embodiment of the device;

FIG. 8 is a longitudinal-sectional view of a winding support of varying cross section and centerable end rings:

FIG. 9 is a side view of a winding support having a conical envelope with diameters that vary among themselves:

FIG. 10 is a fragmentary, side-elevational view of a winding support with interrupted intermediate rings:

FIGS. 11 and 11*a* are side-elevational views of embodiments of a winding support with other spacer elements:

FIGS. 12 and 12*a* are side-elevational views of the winding supports according to FIG. 11 and 11*a* in an axially deformed state;

FIGS. 13 and 13*a* are cross-sectional views taken along the lines F-G and Fa-Ga according to FIGS. 11, 12 and 11*a*, 12*a*, respectively;

FIG. 14 is a view of a simplified embodiment of the winding support according to FIGS. 11 and 12;

FIG. 15 is a side-elevational view of a winding support with predeformed spacer elements having predetermined buckling points; and FIG. 16 is a fragmentary, diagrammatic, cross-sectional view taken along the line I—I in FIG. 14, in the direction of the arrows.

Winding sleeves which are known in the art in a great variety of shapes and deformation behaviors, can only be produced of thermo-plastics in molds which can be appropriately split. This does succeed in giving the winding sleeve a structure enabling it to obtain a desired deformation behavior of the winding sleeve during its application. However, the disadvantage is the great expense of the molding tools required.

As described above, winding sleeves have already been produced in a four-cheek or four-jaw tool. This makes the tool or mold less expensive, but it is still difficult to lay it out for mass production because of the multiple separation which must occur in two planes. In addition, such a simplified mold or tool has only been used to produce a very simply constructed winding sleeve or tube.

The features of the invention meet the objectives by obtaining the most varied deformation behavior of the winding sleeve or tube through suitable construction, while producing the respective winding sleeve or tube with only a two-cheek or two-jaw mold or tool which, accordingly, need only be separated in one plane.

Figure 1:
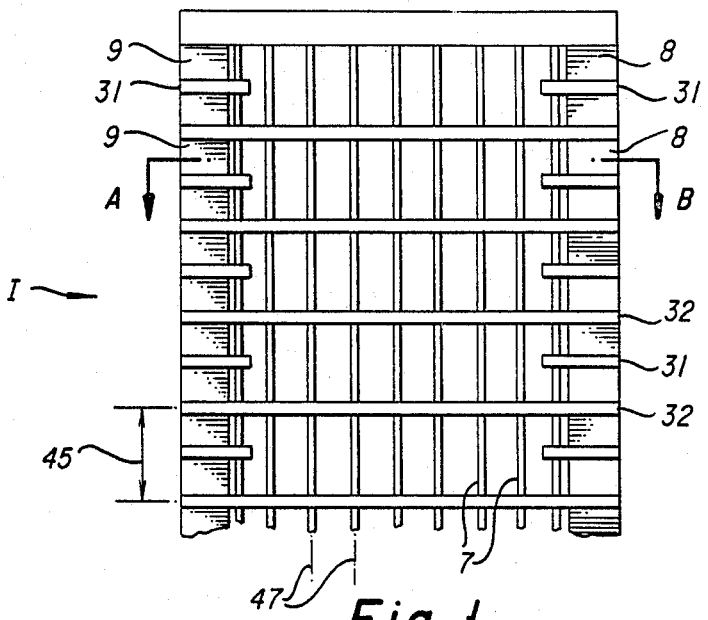
Figure 2:
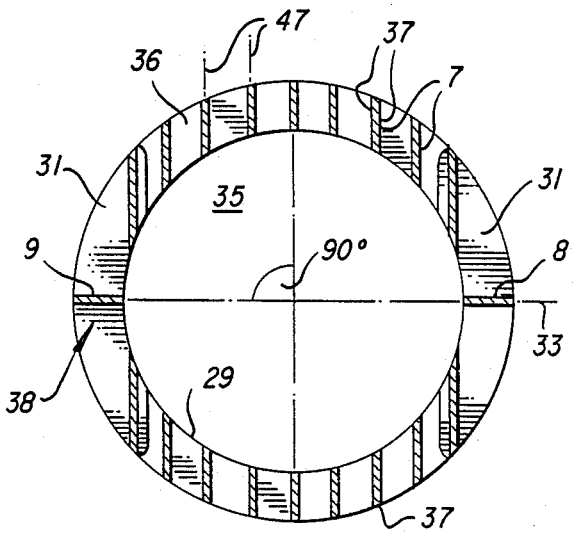
FIG. 2 is a cross-sectional view taken along the line A-B in FIG. 1, in the direction of the arrows.
Figure 1A:
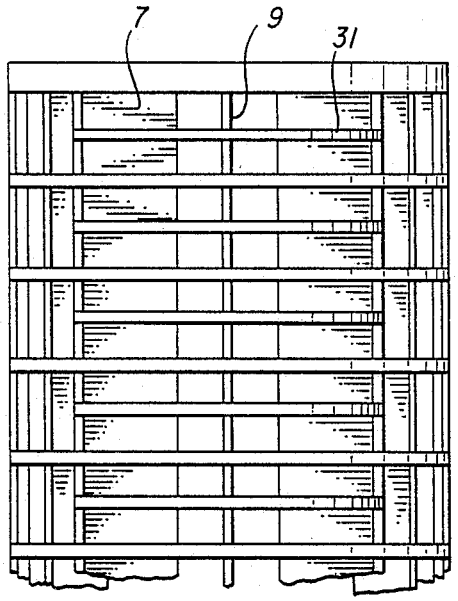

Referring now to the figures of the drawings in detail and first, particularly to FIGS. 1, 1*a* and 2 thereof, there is seen a winding support which is rigid in axial and radial directions. The winding support has several superposed intermediate rings 32 which define planes or ranges 45 and which are mutually spaced apart by spacer elements 7 disposed in the planes 45. The spacer elements 7 are each disposed one alongside the other in equal axial sectional planes 47, and are all aligned in the direction of the axial sectional planes 47, so that they have unidirected generating or surface lines in the alignment direction. Accordingly, all of the spacer elements 7 lie in mutually parallel planes 47, dividing the winding support into slices, so to speak, in axial direction. Therefore, generatrices or generating lines or surfaces 37 are located in such a manner that a tool or mold which is not fully illustrated can be split along a first sectional plane 33 and can be closed or opened perpendicular to this first sectional plane 33, with all of the surfaces or surface or generating lines 37 of the spacer elements 7 extending in second sectional planes in the travel direction of the two mold jaws or cheeks. A shell ring 36 is constructed by means of non-illustrated end rings and the intermediate rings 32 disposed between them and kept mutually spaced by the spacer elements 7. However, the above-described arrangement of the spacer elements 7 results in the shell ring 36 having a free area on both sides adjacent the outermost spacer elements 7, which may be undesirable. The free area can be eliminated by spacer elements 8 and 9, respectively, which are aligned in the direction of the first sectional plane 33 and have generating or surface lines or surfaces 38, as may be seen in FIG. 2. Since these spacer elements 8 and 9 lie in this sectional plane 33 which simultaneously represents the plane of operation of the mold, the winding support can be produced in a mold having only a single plane of operation, despite the altered arrangement of these spacer elements 8 and 9. For space accommodation and, if desired, for further support in lateral areas, ring segments 31 may additionally be disposed parallel to the intermediate rings 32 and held by the spacer elements 8 and 9 as well as the first adjacent spacer elements 7. The interior 35 of the shell ring 36 is filled by a so-called dyeing spear, shaft, or spindle which may use the inner periphery 29 as a guide surface. In order to achieve the separability of the required mold in one single plane, namely the first sectional plate 33 separation plane, it must always be assured that the principal alignment directions of the spacer elements 7 and 8, 9, respectively, are turned 90° relative to each other. Only a single row of spacer elements 8 and 9, respectively, disposed one exactly below the other, must be present in the first sectional plane 33, whereas the other spacer elements 7, which are shifted relative to the elements 8, 9 by 90°, may all be disposed parallel to each other in this shifted position but may also be mutually staggered.

Figure 3:
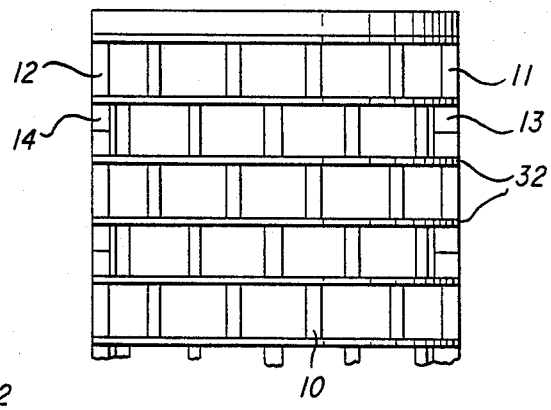
FIG. 3 is a side-elevational view of a part of a winding support.
Figure 4:
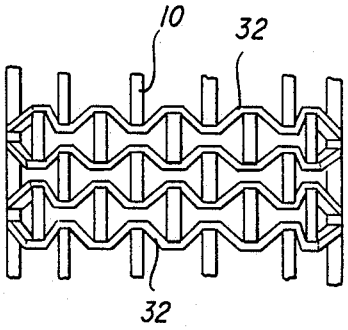
FIG. 4 is a view of the winding support of FIG. 3, in deformed state.

The embodiment just described above is shown in FIGS. 3 and 4. FIG. 3 shows the winding support in an undeformed state. In this embodiment as well, the intermediate rings 32 are kept mutually spaced apart by spacer elements 10 aligned in the above-described manner, but these spacer elements 10 are staggered relative to each other in circumferential direction. In the first plane of separation 33, which is not shown in FIGS. 3 and 4, spacer elements 11, 13 and 12, 14, respectively, are alternatingly disposed one below the other. In this structure, the spacer elements 11 and 12 are preferably rigid, as are the spacer elements 10, while the spacer elements 13 and 14 are deformable by an axial load. This ensures that upon an axial deformation, a radial deformation also occurs automatically, as FIG. 4 shows.

Figure 5:
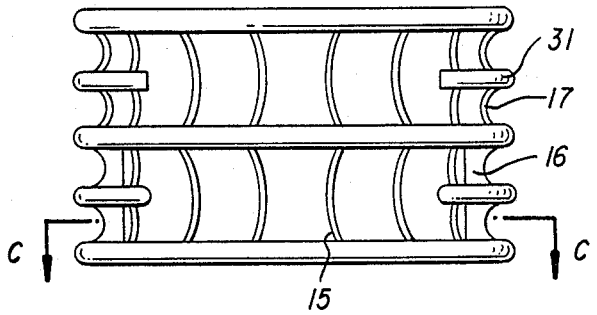
FIG. 5 is a side-elevational view of part of a winding support.
Figure 6:
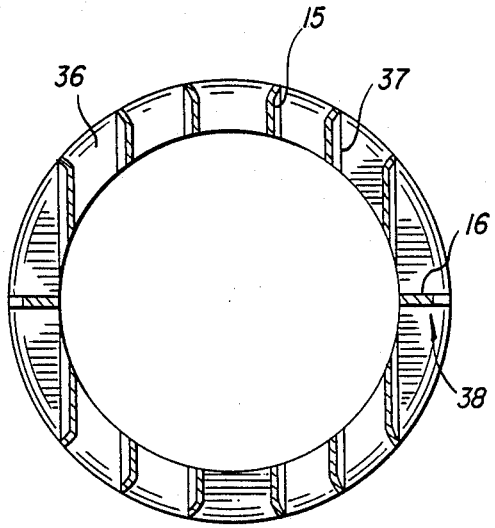
FIG. 6 is a cross-sectional view taken along the line C—C in FIG. 5, in the direction of the arrows.

FIGS. 5 and 6 show a variation of the embodiment according to FIGS. 1 and 2. The spacer elements 15 of FIGS. 5 and 6 already have been given a pre-bent shape. However, the bend is in opposite directions on the two sides of a plane of symmetry perpendicular to the first sectional plane 33. This results in a buckling of the spacer elements 15 in predetermined directions upon axial deformation of the winding support. It is accordingly possible, depending on the desired deformation behavior of the winding support to place spacer elements 17 with the same alignment and flexure as the spacer elements 15, in the first sectional plane 33. However, rigid spacer elements 16 may also be provided there. In the embodiment according to FIGS. 5 and 6, the spacer elements 15, 16, or 17 are again all located within the shell ring 36, and a so-called dyeing spear or shaft may again be disposed in the interior 35 of the shell ring 36. In this case as well, it can be clearly seen that the generating or surface lines 37 of the spacer elements 15 and 17 run parallel to each other in such a fashion as to extend in the travel direction of the two cheeks or jaws of a mold which separates in the first sectional plane 33. As an alternative to the spacer elements 17, the spacer elements 16 may also lie in the first sectional plane 33. Generating or surface lines or surfaces 38 of the elements 16 are then parallel to the first sectional plane 33, so that the separation of the mold in this plane for the production of the winding support, is not adversely affected.

In the embodiments according to FIGS. 7, *7a*, *7b*, and *7c*, totally different spacer element shapes are used, and it is seen that such shapes can also be handled perfectly with a mold or tool that is separable in one plane only. FIG. 7 shows a winding support having spacer elements 18 which have the shape of cylindrical tubing pieces placed between the intermediate rings 32. The elements 18 are aligned in such a way that a section line 39 of planes of symmetry 40 and 41, respectively, of these spacer elements 18, again runs in the travel direction of the two mold jaws or cheeks, and all of these section lines 39 are parallel to each other. Additionally, planar, fixed, spacer elements 18 may also be provided in the first sectional plane 33 within the shell ring 36, as shown in FIG. *7a*. A deformation behavior which is desirable for such a winding support can be obtained in certain cases by using this combination as well.

A complementary variation is shown in FIGS. *7b* and *7c*, wherein the spacer elements 18 have inner generating or surface lines 37 and outer generating or surface lines 42' running in the direction described above, and these spacer elements 18 according to FIGS. *7b* and *7c* also have outer generating lines 42 and inner generating lines 37' diverging relative to each other in the direction of the interior 35 and exterior 35' of the winding support, respectively. This makes it possible to obtain a greater deformation resistance in the inner area than in the outer area, and yet mold cheeks or jaws which separate in only one plane can be used.

FIGS. 8 and 9 show that a winding support with varying cross section of a body 1 can be produced without difficulty with mold jaws or cheeks that are separable in one plane only. The diameters of the intermediate rings 32'' determine the cross-sectional shape of the winding support body 1. In addition, in FIG. 8 an end ring 2 having both inner centering means 3 and outer centering means 4, is molded to the body 1. For instance, the body 1 can be centered on a dyeing spear or shaft by means of the inner centering means 3. An end ring 5 with inner centering means 6, is molded to the other end of the body 1. In this way, outer centering means 4 are located at the bottom of the end ring 2 of the next body of this kind and can be inserted in the inner centering means 6 of end ring 5. The body is then securely held and guided. The end ring 5 may additionally have a spare or reserve thread groove 46.

FIG. 8 also shows a winding support equipped with spacer elements of different kinds in an axial sequence. The spacer elements may be molded to a single winding support or they may be present in only one version in a winding support, while passing through it separately. These spacer elements 18' and 26, respectively, represent variations of spacer elements which are deformable in axial direction.

The structure shown at the bottom of FIG. 8 has spacer elements 7'' combining different intermediate rings in groups. The spacer elements 7'' are mutually staggered in circumferential direction. This structure permits an axial mobility with forced radial mobility, but the winding support essentially only shrinks in its inner area while its outer axial dimensions deform much less. Such a behavior may also be desired.

In a variation according to FIG. 10, open hollow parts 34 such as in the form of pieces of tubing, are molded into the intermediate rings 32'. The rings 32' are kept mutually spaced apart in the first sectional plane 33 which is not illustrated in FIG. 10, by axially rigid spacer elements 8' and 9', respectively. Rigid spacer elements 7' are also provided in axial direction in the parallel planes running perpendicular to the first sectional plane 33, and are disposed one under or alongside the other in the embodiment according to FIG. 10. In the embodiment shown, this makes it possible to obtain a radial deformability in one direction, while the direction running perpendicular thereto is radially rigid. In the embodiment, the device is rigid in the axial direction in addition. However, according to the embodiment of FIG. 10, it is also possible to provide spacer elements of the above-described kind, shape, and arrangement so that a two-stage deformability of the winding support is achieved. If the initially provided deformability is insufficient for the respective application, it is then possible for the winding support to deform, e.g. in a plane as described in connection with FIG. 10, when a certain force is exceeded, so that damage to the wound material or incorrect dyeing can be prevented.

In FIGS. 11 to 13 an embodiment is depicted which is similar to that which has been described in connection with FIGS. 5 and 6. According to FIGS. 11 to 13, the intermediate rings 32 are kept mutually spaced apart by spacer elements 19 and 20, respectively, which are prebent and are disposed on both sides of a center plane, perpendicular to the first sectional plane 33. The spacer elements are aligned in the manner described above, with their flexures opposing each other on both sides of the plane. Spacer elements 21 and 22 are located in the outer rim area of the first sectional plane 33 supporting ring segments 31 together with the spacer elements 19 and 20 located adjacent thereto toward the inside. An axial deformation at the winding support will cause the ring segments 31 to move radially inward, so that after the axial deformation, additional room in radial direction is obtained overall, due to the radially inward motion of the ring segments 31, this occurs although the intermediate rings 31 retain their diameter. However, since the ring segments 31 are caused to move radially inward, enough room for to the dyeing spear must be provided. This problem is eliminated by the embodiments according to FIGS. 11*a* to 13*a*. In these embodiments, the intermediate rings 32 have an oval inner opening seen in (FIG. 13*a*, and the ring segment 31 is shaped accordingly, so that a circle 48 having approximately the diameter of the non-illustrated dyeing spear is formed in the deformed state of the winding support.

FIGS. 14 and 15 show simplified forms of the winding support according to FIGS. 11 and 13, with the ring segments 31 missing. Particularly in FIG. 15, spacer elements 25, 26, 27 and 28 are provided, which are pre-shaped and provided with a predetermined buckling point 43. A deformation of these spacer elements in a predetermined direction is thereby achieved.

FIG. 16 shows an embodiment in which the spacer elements 19', at least in connection regions 49, 50 thereof, have decreasing widths in direction from the outside 51 of the winding support.

It has been demonstrated through many different embodiments, that it is possible to construct a winding support in such a way that all of the desired types of deformability can be obtained, and yet that every one of these winding supports constructed in this way can be produced in a two-cheek or two-jaw mold or tool which, consequently, is separable in a single plane only. The decisive factor is that all of the elements used in the construction of the winding support are aligned in such a way as not to hinder the in and out motion of two cheeks or jaws of a mold. Nevertheless, in the plane of separation, and only in this one plane, winding support elements may be molded, which are located one below the other and which are extended in a principal direction which is shifted by 90° relative to the principal direction in which the other elements are extended. This is possible because placing such elements in the plane of separation does not hinder the separation of the mold. Accordingly, all requirements concerning the deformability of such winding supports can be met by a mold having only one plane of separation for its mold jaws. Therefore, a device has been constructed with shapes which can be produced with a very simply constructed mold while retaining all of the desired advantages, it having become possible thereby for the first time to construct winding supports with the greatest variety of shapes for the greatest variety of requirements, yet which are producible in a single or multiple two-cheek or two-jaw mold, because only one single plane of separation is needed. Despite the fact that a multiplicity of such winding supports can be molded simultaneously, the mold required remains relatively small and inexpensive.

I claim:

1. A winding support for treatment of threads or yarns being molded as a single part in a mold having two mold parts, and a separation plane separating the two mold parts, the support comprising a shell ring having openings formed therein, said shell ring having two end rings, and intermediate rings disposed between said end rings, said intermediate rings being formed of a multiplicity or ring elements, and spacer elements interconnecting said ring elements in said shell ring, all of said ring elements and spacer elements having surfaces being perpendicular to said separation plane for allowing the mold parts to separate from the molded winding support, including two rows of additional ring elements oppositely disposed, axially stacked between said intermediate rings, said separation plane being a plane of symmetry of said additional ring elements, said winding support being molded as one piece of material.

2. Winding support according to claim 1, wherein said shell ring a diameter disposed in said separation plane and including other spacer elements being disposed one below the other and opposite each other, each of said other spacer elements being disposed between a respective two of said ring elements, said other space elements having surfaces disposed parallel to said separation plane, said surfaces of said first-mentioned spacer elements being disposed in sectional planes offset by 90° from said separation plane.

3. Winding support according to claim 2, wherein two of said other spacer elements are each disposed between a respective one of said ring elements and a respective one of said end rings.

4. Winding support according to claim 2, wherein said first-mentioned spacer elements are offset in circumferential direction relative to the next adjacent one of said first-mentioned spacer elements.

5. Winding support according to claim 2, wherein said spacer elements are rigid in axial direction.

6. Winding support according to claim 2, wherein said first-mentioned spacer elements are rigid in axial direction, and said other spacer elements are alternately rigid and soft in axial direction.

7. Winding support according to claim 6, wherein said other spacer elements include inner elements being soft in axial direction and outer elements disposed furthest outside being rigid.

8. Winding support according to claim 2, wherein said first-mentioned spacer elements are at least partial boundary surfaces of hollow bodies being open at least at outer ends thereof.

9. Winding support according to claim 8, wherein said shell ring has an interior region and an exterior region, said hollow bodies each have a pair of inner and a pair of outer surfaces, said surfaces of one of said pairs of surfaces diverging toward one of said regions of said shell ring, each of said hollow bodies having planes of symmetry with section lines extended perpendicular to the axial direction of the winding support and parallel to said section lines of the others of said hollow bodies.

10. Winding support according to claim 8, wherein at least some of said hollow bodies have surfaces disposed along said first sectional plane.

11. Winding support according to claim 2, including hollow bodies formed in at least a plurality of said intermediate rings interrupting said intermediate rings in circumferential direction, said hollow bodies being aligned with at least said first-mentioned spacer elements being spaced from said separation plane, and being open at least at ends thereof.

12. Winding support to claim 11, wherein said hollow bodies formed in adjacent intermediate rings are interconnected forming additional spacer elements.

13. Winding support according to claim 2, wherein the winding support has a body with an inner surface with an at least partially oval cross section along the direction of said first sectional plane, except at said end rings.

14. Winding support according to claim 2, wherein at least some of said spacer elements have predetermined buckling points.

15. Winding support according to claim 2, wherein said spacer elements have a shaped chosen form the group consisting of: straight, oblique, buckled, bent, C-shaped, O-shaped, and S-shaped.

16. Winding support according to claim 1, wherein said intermediate rings have increasing diameters as seen in a given direction.

17. Winding support according to claim 1, wherein said intermediate rings have intermittently increasing and decreasing diameters as seen in a given direction.

18. Winding support according to claim 1, wherein at least said spacer elements supporting said rings segments have bends formed therein for inwardly shifting said ring segments upon axial movements of adjacent ones of said intermediate rings.

19. Winding support according to claim 1, wherein said ring elements forming said intermediate rings have at least one of the shapes chosen from the group consisting of: straight, buckled, wave-shaped, and a shape provided with predetermined buckling points.

20. Winding support according to claim 1, wherein the winding support has a body with two ends at which said end rings are disposed, one of said end rings having inner centering means for centering a dyeing spear and outer centering means for an end ring of another body, and the other of said end rings having centering means for said outer centering means of a further body.

21. Winding support according to claim 1, wherein said spacer elements are alternately rigid and soft in axial direction of the winding support.

22. Winding support according to claim 1, wherein said spacer elements are disposed in adjacent ranges, and all of said spacer elements in a given range are disposed in the same axial sectional planes as said spacer elements of said adjacent range.

23. Winding support according to claim 1, wherein said intermediate rings have the same diameter as the end rings.

24. Winding support according to claim 1, wherein said additional ring elements are formed as ring segments and are supported by said spacer elements.

25. A winding support for treatment of threads or yarns being molded as a single part in a mold having two mold parts, and a separation plane separating the two mold parts, the support comprising a shell ring having two end rings, and intermediate rings having the same diameter as the end rings disposed between said end rings, said intermediate rings being formed of a multiplicity of ring elements; and spacer elements interconnecting said ring elements in said shell ring, all of said ring elements and spacer elements having surfaces being perpendicular to said separation plane for allowing the mold parts to separate from the molded support; said winding support being molded as one piece of material; other spacer elements having surfaces being parallel to said separation plane, and two rows of ring segments oppositely disposed, axially stacked in opposing pair halves between said intermediate rings and supported by said first-mentioned spacer elements and said other spacer elements.

* * * * *